United States Patent [19]

Schippers

[11] 4,185,064

[45] Jan. 22, 1980

[54] PROCESS FOR HIGH SPEED PRODUCTION OF FILAMENT CABLES

[75] Inventor: Heinz Schippers, Remscheid, Fed. Rep. of Germany

[73] Assignee: Barmag Barmer Maschinenfabrik AG, Remscheid-Lennep, Fed. Rep. of Germany

[21] Appl. No.: 850,852

[22] Filed: Nov. 11, 1977

[30] Foreign Application Priority Data

Nov. 22, 1976 [DE] Fed. Rep. of Germany ..... 2653010

[51] Int. Cl.[2] ..... D01D 5/12

[52] U.S. Cl. ..... 264/210.2; 28/289; 264/103; 264/342 R; 264/210.8

[58] Field of Search ..... 264/210 F, 103, 342 R; 28/289, 21

[56] References Cited

U.S. PATENT DOCUMENTS 4,069,566 1/1978 Sumitomo et al. ..... 264/168

FOREIGN PATENT DOCUMENTS 51-32826 3/1976 Japan .

*Primary Examiner*—Jay H. Woo

*Attorney, Agent, or Firm*—John H. Shurtleff

[57] ABSTRACT

Filament cables of denier above 10,000 dtex are produced by operating several continuous melt spinning-stretching processes at production speeds above 3,000 m/min, to form several continuously spun and stretched filament bundles, which bundles are then continuously plied and deposited in the form of a cable.

The process among others is useful for high speed production of filament cables of nylon-6 with improved breaking strength and/or breaking extension.

16 Claims, 4 Drawing Figures

PROCESS FOR HIGH SPEED PRODUCTION OF FILAMENT CABLES

The invention relates to processes for production of a filament cable with a denier of more than 10,000 dtex (weight in grams of 10,000 meters cable length) with production speeds over 3,000 meters per minute, by continuous melt-spinning and stretching of several filament bundles, plying the bundles continuously into a cable, and depositing the cable, wherein the filament bundles are individually stretched before they are plied into a cable and deposited.

Suitable thermoplastic, filament-forming polymers are, for example, polyesters, such as polyethylene terephthalate, the polyamides, such as, for example PA 6 (Perlon, Nylon-6), PA 6,6 (Nylon) and polypropylene.

Copending application Bag. 1005 filed simultaneously herewith by the same inventor is directed to related subject matter of a melt spinning and stretching process of Nylon-6 and is therefore incorporated herein by reference as fully as if set forth in its entirety. (German Appl. No. P 26 51 428.3)

It is known practice, for the production of a filament cable to draw capillary filaments extruded from spinning nozzles, to ply bundles of these filaments to a cable of more than 10,000 dtex and to deposit the cable in a can. The deposited cable, in a further operating process, is drawn out of the can and stretched in a separate stretching mechanism.

This separation into two separated operations of spinning and stretching is necessary, since the required stretching mechanism, in which are operated one or more cables of more than 10,000 dtex cannot be driven at the high speeds attainable nowadays for economic production, because the stretching mechanism, to stretch such filament cables must exert enormous pulling forces. Because of these pulling forces, the godets of such stretching mechanism have to have journal supports on both ends of their shafts, instead of the usual cantilever journal support, thereby considerably increasing the space requirements for the stretching mechanism.

This subdivision into two operations can up to now only be avoided by spinning capillary filaments at a very low speed of approx. 100 meters per minute to thereby provide a sufficient period of dwell for the plied cable in the stretching mechanism in order to attain uniform heating and to thereby generate sufficiently good filament qualities. Here, too, a very massive stretching mechanism layout is necessary for the high pulling forces to be exerted.

It is an object of the present invention, therefore, to provide a process and an apparatus suited for the production of a filament cable of more than 10,000 dtex in a continuous operation of spinning, stretching and depositing, it being possible to realize production speeds of a high denier filament cable in excess of 2,500 meters per minute.

In accordance with the invention, filaments of a thermoplastic synthetic polymer are melt spun through a plurality of spinning nozzles in a continuous process. The filament bundles from respective spinning nozzles are continuously and individually stretched. Thereafter, the stretched bundles are plied into a filament cable of more than 10,000 dtex, and the cable deposited in a coil form in a collector, for example, a can.

By the use of the individual stretching mechanism which has the cantilever type of journal support for the stretching godets, a construction favorable from the point of view of the tending of the godets by personnel is provided. The applying of the capillary filament bundles is substantially facilitated, achieving the advantage that, in case of breakages (which occur most often in the stretching mechanism or wraps of filaments around the godets), only the stretching line concerned is interrupted. Since the generated filament cable is processed later into staple fibers, the temporary drop out of one filament bundle plays no role in the appraisal of the quality of the staple fibers. In contrast to this, in the previously known installations for making filament cables, the complete stretching mechanism had to be stopped and again restarted in the case of substantial filament breakages or wraps or other irregularities in which case all the other spun capillary filaments to be used in the cable had to be discharged or accumulated as waste or rejects until the stretching mechanism was restarted.

By capillary filament bundle as applied in this invention there is meant a coalition of capillary filaments that lies in the order of more than 1,000 dtex and up to 5,000 dtex, a filament cable consisting at least of three bundles of a total of at least 10,000 dtex. It is a further object of the invention to provide heating of high denier cables by applying heat to the separate filament bundles before the bundles are plied into the cable.

For the production of filament cables which have several ten-thousand dtex, the process of the invention provides a new type of process embodying the feature that each spun fiber bundle is continuously stretched in its own stretching zone, each consisting of a first and a second godet mechanism, and that only thereafter are the filament bundles combined (plied) into a cable and deposited in a collector, e.g., a cannister, box or barrel. If need be, the shrinkage treatment for each filament bundle can take place before the plying, again in each case in a separate shrinkage zone, which then consists expediently of the second and third godet mechanism. The shrinkage also can take place after the plying, i.e., between the second godet mechanism and the collective draw-off mechanisms through which run the filament bundles being plied into a cable. For this the peripheral velocity of the draw-off mechanism should be 3 to 12 % less than the peripheral velocity of the particular second godet mechanisms. Further, it is also possible to carry out a first shrinkage in a shrinking zone provided separately for filament bundle and to carry out an after-shrinkage between the last godet mechanism of the respective shrinkage zones and the collective draw-off mechanism.

The process of the invention can be employed advantageously to produce continuous filaments and cables thereof in the capillary range from 1.5 to 10 dtex and in the predominant total denier range of 10,000 to 100,000 dtex for the filament cables.

The apparatus of the invention comprises a series of side-by-side spinning units with their respective vertical drop shafts (spinning shafts, quenching shafts) preferably aligned in a row, i.e., lying in a vertically disposed, horizontally elongated plane. Each spinning unit generates at least one filament bundle, which exits from the lower end of the drop shaft and is deflected by a respective deflecting means below the outlet end of the shaft. The respective bundles run substantially in the same horizontal direction to a common cable draw-off mechanism and join one another in their travel toward the mechanism to form the plied cable. The subject apparatus is characterized by stretching mechanisms for each spinning unit, or for each pair of spinning units, to stretch each filament bundle just after exit from its spinning shaft, separately from the others but under the same conditions of speed, draw ratio and heat treatment as the others. In many cases, cooling of the filaments can be improved by spinning a limited number of filaments in each of two spinning shafts and to conduct all these filaments to a single stretching mechanism for forming one filament bundle, the total denier of which is not higher than 5,000 dtex. Following each stretching mechanism is the aforesaid deflecting means.

This arrangement of the stretching units directly beneath the spinning shafts provides a space utilization advantage ordinarily the spinning is done vertically downward, and the space available under the spinning nozzle and spinning shaft has been used ineffectively only by the draw-off mechanism in prior, known installations. With this invention, however, it is possible to arrange, instead of the draw-off mechanism, the individual stretching mechanism in this space whereby the relatively large space normally needed by the normally horizontally oriented stretching mechanism is eliminated. Therefore, the total space requirement for the filament cable installation is substantially reduced.

Where a filament shrinkage treatment to provide precisely defined values of shrinkage or total stretching is required, a mechanism, e.g., a godet mechanism, is provided between the respective stretching mechanism and the deflection means for shrinkage treatment of each filament bundle, i.e. before they are plied into the filament cable.

A further advantage of the invention resides in arrangement of the stretching mechanisms directly underneath the spinning nozzles and shafts, whereby the total heat energy requirements of the overall installation can be reduced substantially. Moreover, a substantial improvement in the quality of the filament cable produced is realized because, by virtue of the individual stretching, there is improved uniformity in the heat treatment of all filaments in the stretching steps, whereby all the capillary filaments are stretched at substantially uniform temperatures - thereby providing an ultimate filament cable without substantial variations in properties of the individual filaments.

The invention is explained in more detail below with reference to the preferred embodiments which are illustrated in the drawings, wherein.

Figure 1:
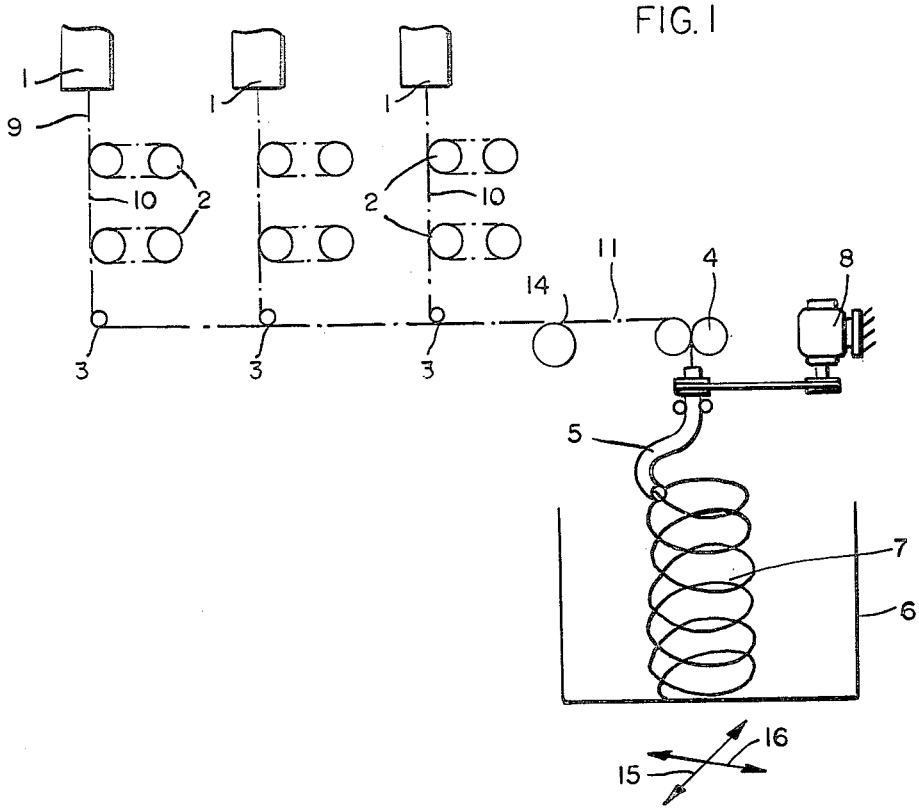
FIG. 1 is a schematic diagram of apparatus for spinning, stretching, plying and collecting of the plied cable according to the process of the invention.

FIG. 1 shows schematically the extruder 1, in which for example polyamide-6 cuttings are molten and supplied through duct 2 under high pressure to the spinning head 3. The spinning head contains among other things the spinning nozzle plates 4, from which is spun a plurality of 500 to 3,000 individual capillaries (filaments) 5. The individual capillaries are blown by cooling air directly under the spinning nozzle plate in blowing and cooling zone 6. They then pass through the spinning shaft 7, emerge as filament bundle 8, are moistened by the finishing godet (not shown) and are drawn off by the first conveyance mechanism, the first godet mechanism 9. The first godet mechanism in the preferred embodiment of the invention consists of two heated rollers 9.1 and 9.2, which are journaled cantilever fashion to the machine front. Rollers 9.1 and 9.2 are encircled several times by filament bundle 8, which is then fed to the second godet mechanism, the stretching mechanism 10. This second godet mechanism is driven at a peripheral velocity which is highher by the prescribed stretching ratio than is the peripheral velocity of the first godet mechanism 9. It also contains two rollers 10.1, 10.2, constructed in the same way as rollers 9.1 and 9.2. Rollers 10.1 and 10.2 may be heated, what is especially useful if draw-off mechanism 14 is driven at lower peripheral speed for providing shrinkage to the filament cable 19. In any case heat is imparted only to the bundles before plying, so that uniform heating is effected. Following godet mechanism 10, the individual bundles 8 are deflected by deflecting rolls 13 and are plied and fed collectively to the draw-off mechanism 14. Between godet mechanism 10 and the collective draw-off mechanism 14 the plied bundles can, as mentioned and if necessary, shrink, by setting the peripheral velocity of the draw-off mechanism 14 upto 10 % lower than that of the godet mechanism 10. A liquid finishing may be applied, if desired, to the plied bundle by finishing roller 22. Both rollers of draw-off mechanism are driven by motor means (not shown). One of the rollers is moveable and pushed against the other one to form a nip in which the filament cable is clamped.

After the draw-off mechanism 14, the filament cable 19 collectively passes through a rotating tube 15, driven by motor 18. By passing through the curvate passage of the tube 15, the cable is laid in the form of superposed coils 17 in the can or container 16. The can or container 16 preferably is given an eccentric motor or a dual vector linear motion, which is represented by arrows 21. Depositing of the cable is effected without any substantial tension and at a running speed, i.e. speed in the direction of the filament axis, which is substantially "zero" and may be between ±10 % of the previous running speed imparted by draw-off mechanism 14.

Figure 2:
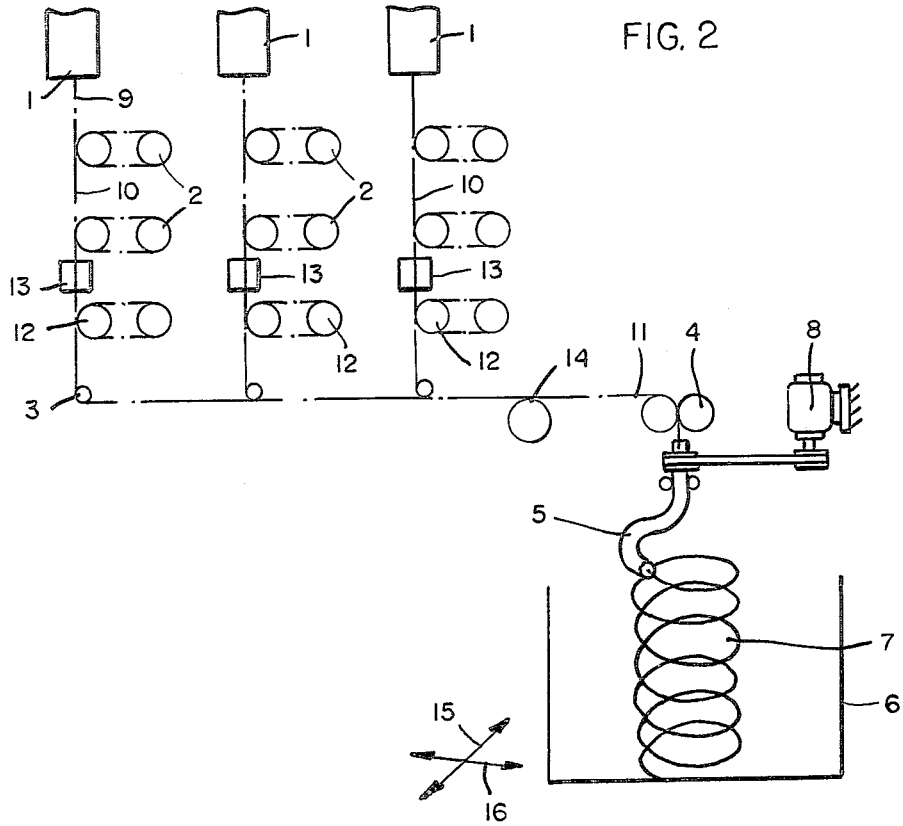
FIG. 2 is a schematic diagram of apparatus for spinning, stretching, plying and collecting of the plied cable with a godet mechanism for shrinkage treatment of the filament bundles.

The embodiment of FIG. 2 is the same installation as in FIG. 1. Each stretching mechanism 10, however, is followed by a godet mechanism 12, which allows the filament bundles to relax slightly and thereby shrink when godet unit 12 operates at a slightly lower peripheral velocity than that of the godet unit 10. The godet members 12 are similar to the stretching mechanisms 9 and 10 in the respective individual spinning units 1. Obviously, it is also possible, if low denier values allow same, to use two spinning units in combination with only one line of stretching mechanism and shrinkage mechanism.

The cable 11 may be finished and/or lubricated by a liquid applied thereto by the finishing roll 22. The can or container 16 ordinarily is moved eccentrically or is reciprocated in two directions to move the coils 17 horizontally relative to the underlying, deposited coils in the container 16, such movement being indicated by the arrows 21. It should be mentioned that the deflection members and the godet mechanism 10 in FIG. 1 and godet mechanism 12 in FIG. 2 respectively may be identical, so that said godet mechanisms serve as deflections members.

Figure 3:
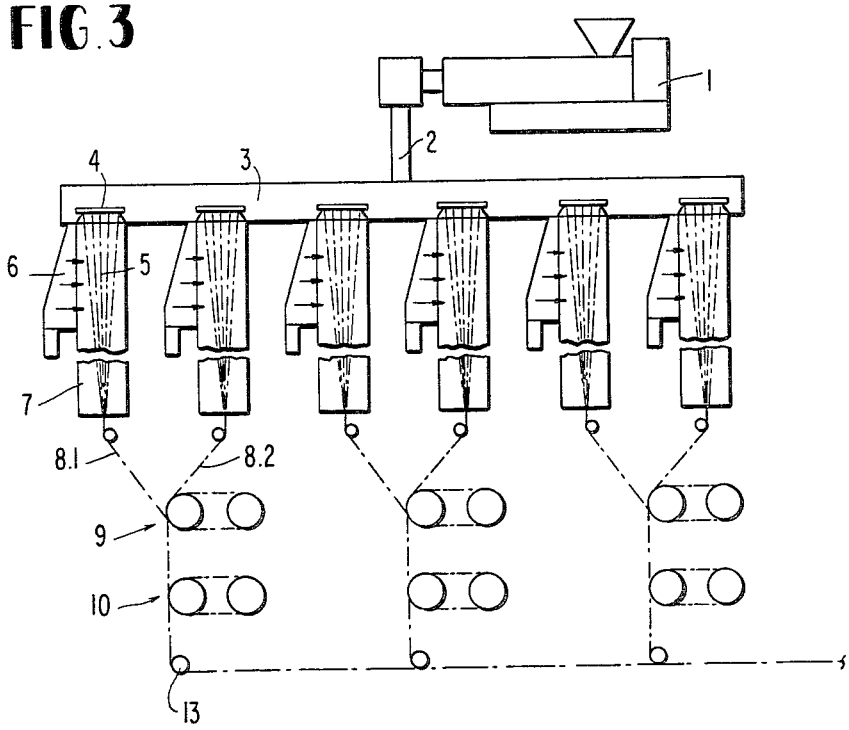
FIG. 3 is a schematic diagram similar to FIG. 1, showing two bundles to be stretched on one stretching mechanism.

FIG. 3, which is generally identical to the schematic diagram of FIG. 1 shows that bundles 8.1 and 8.2 of filaments are spun each in a separate spinning shaft 6 and that each pair of bundles 8.1 and 8.2 are led to a stretching mechanism, consisting of rollers 9 and 10. An installation of this type is applicable, if the bundles have a relatively low denier within the scope of this invention. To spin filament bundles of a lower denier might exceptionally be useful to achieve good results in cooling and quenching of the filaments.

Figure 4:
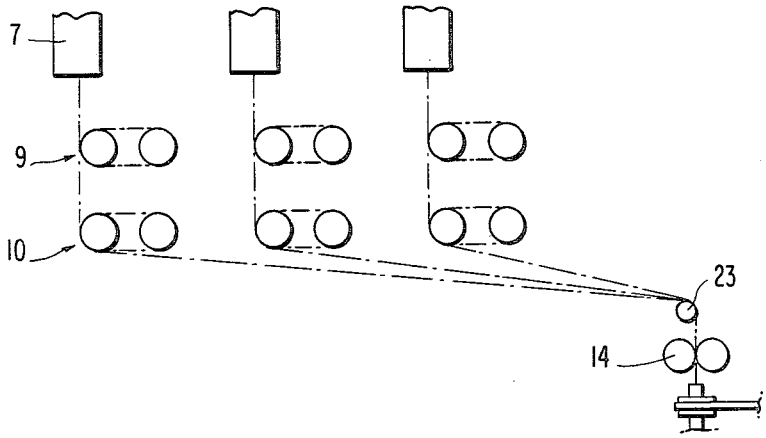
FIG. 4 is a schematic diagram showing another way of deviating and plying the bundles.

FIG. 4 shows another modification of a spinning installation, which might be useful, if there are restrictions in space. In conformity with the installation shown in FIG. 1 there are indicated the end portions of the spinning shaft 7, the bundles 8, the stretching mechanism consisting of rollers 9 and 10 and the draw-off mechanism 14. In this installation, the second stretching roller 10 serves as deflecting member for deflecting each bundle into a substantially horizontal direction. The bundles are plied to a cable by idle roller 23. The plied cable is drawn off by draw-off mechanism 14.

It should be mentioned that the drawings only show a limited plurality of bundles to be plied to a cable. It is obvious that practically there does not exist such a limitation. In one installation as many as for instance 40 bundles may be produced in 40 parallel production lines, each consisting of spinning unit, stretching unit and eventually shrinking unit in order to ply these 40 bundles into one cable.

It is thought that the invention and its numerous attendant advantages will be fully understood from the foregoing description, and it is obvious that numerous changes may be made in the form, construction and arrangement of the several parts without departing from the spirit or scope of the invention, or sacrificing any of its attendant advantages, the forms herein disclosed being preferred embodiments for the purpose of illustrating the invention.

The process and installation described before allow high production speeds for filament cables of high denier. Further advantages are achieved by spinning at high speeds, i.e. by high peripheral velocity of godet mechanism 9. Insofar, special high quality yarns and cables, for example of polyamide 6 filaments, can be produced by the disclosed process and installation.

The invention is hereby claimed as follows:

1. A process for production of cables of filaments of thermoplastic, melt-spun synthetic polymer at a production speed in excess of 2,500 m/min, the cable having more than 10,000 dtex, said process comprising the steps of simultaneously advancing a plurality of melt streams of at least one of said polymers through a corresponding plurality of at least three spinning nozzles, all nozzles lying in the same horizontal plane, each nozzle having the same quantity of 500 to 3,000 spinning dies, directed in the vertical direction downwards for melt spinning 500 to 3,000 filaments from each nozzle;

leading said filaments spun from each nozzle in a vertical quenching shaft associated to each nozzle for quenching said filaments by a stream of air;

assembling said filaments spun from each nozzle to a bundle of filaments, all bundles having the same amount of filaments and the same denier in the range of 1,000 to 5,000 dtex;

while all bundles are running downwards in a vertical direction parallel to each other and in only one common vertical plane, leading each of said bundles to a stretching zone below each quenching shaft consisting of a first and a second godet means to be wrapped around, the peripheral velocity of said first godet means being in excess of 600 m/min, the peripheral velocity of said second godet means being higher than that of said first godet means to stretch each bundle between separate godet means, associated to each bundle by the same stretching ratio to all bundles;

heating each of said bundles to a uniform temperature above 40° C. during the stretching;

deviating each bundle at a first point below said first and said second godet means to only one second point common to all bundles, lying in said vertical plane at one side of all of said first points to thereby plying said bundles to a cable of at least three bundles, said cable having a denier of more than 10,000 dtex;

after stretching, leading each bundle to a shrinking zone, consisting of said second and a third godet means below said quenching shaft, the peripheral velocity of said third godet means being less than the peripheral velocity of said second godet means for shrinkage of the filaments, each bundle being heated in said shrinkage zone to a temperature between 140° and 230° C.;

advancing said cable with more than 2,500 m/min by only one common draw-off means; and releasing the tension in said cable and decreasing the axial running speed of said cable to less than 10% of its previous velocity for depositing the cable in a horizontal collection plane in a can which is reciprocating in said horizontal plane.

2. A process as claimed in claim 1, the peripheral velocity of said third godet means being 1 to 10% less than the peripheral velocity of said second godet means.

3. A process as claimed in claim 1, wherein each bundle has a denier between 2,000 and 4,000 dtex.

4. A process as claimed in claim 1, wherein at least ten bundles are formed and stretched and after stretching are plied to a cable having at least 20,000 dtex.

5. A process as claimed in claim 1, and heating the bundles in said stretching zone by more than 80 centigrades.

6. A process as claimed in claim 1, and heating said bundles in said shrinking zone to more than 160° C.

7. A process as claimed in claim 1, and heating each bundle when leaving said shrinking zone by heating up said third godet means to at least 80° C.

8. A process as claimed in claim 1, and deviating the plied cable in said one common draw-off means to a vertical direction downwards into a guiding means, rotating said guiding means around a vertical axis in an horizontal plane, releasing the cable from said guiding means in a direction between the radial and the tangential direction of and diverted from the rotary movement of the guiding means to thereby decreasing the axial running speed of the cable to less than 10% of its previous velocity and to thereby make the cable fall down in coils into a can, which is reciprocated in a horizontal plane.

9. A process as claimed in claim 1, for production of cables of polycaprolactam, drawing the spun polycaprolactam capillaries from the spinning nozzle at a draw-off velocity above 3,500 meters per minute, and thereafter, promptly after their exit from the spinning zone, stretching the solidified filaments in a stretching zone at a stretching ratio of 1:1.1 to 1:1.5.

10. A process as claimed in claim 9, wherein the polycaprolactam filaments are drawn from the spinning zone by running the filaments about the first godet mechanism, rotating at a peripheral velocity in the range of 3,800 to 5,500 meters per minute.

11. A process as claimed in claim 9, wherein said stretching of the bundles is carried out at a filament temperature in the range of 40° to 100° C.

12. A process as claimed in claim 9, wherein said stretching of the filaments is carried out at a filament temperature in the range of 40° to 100° C., the godets of said first godet mechanism being heated to 40° to 100° C.

13. A process as claimed in claim 12, wherein said second godet mechanism has a temperature above 130° C., and passing the stretched filaments from said second godet mechanism to a third godet mechanism rotating at a lower peripheral velocity than that of the second godet mechanism to allow the filaments to shrink in the shrinkage zone between said second and third godet mechanisms.

14. A process for production of cables of filaments of thermoplastic, melt-spun synthetic polymer at a production speed in excess of 2,500 m/min, the cable having more than 10,000 dtex, the process comprising the steps of simultaneously advancing a plurality of melt streams of at least one of said polymers through a corresponding plurality of at least three spinning nozzles, all nozzles lying in the same horizontal plane, each nozzle having the same quantity of 500 to 3,000 spinning dies, directed in the vertical direction downwards for melt spinning 500 to 3,000 filaments from each nozzle;

leading said filaments spun from each nozzle in a vertical quenching shaft associated to each nozzle for quenching said filaments by a stream of air;

assembling said filaments spun from each nozzle to a bundle of filaments, all bundles having the same amount of filaments and the same denier in the range of 1,000 to 5,000 dtex;

while all bundles are running downwards in a vertical direction parallel to each other and in only one common vertical plane, leading each of said bundles to a stretching zone below each quenching shaft consisting of a first and a second godet means to be wrapped around, the peripheral velocity of said first godet means being in excess of 600 m/min, the peripheral velocity of said second godet means being higher than that of said first godet means to stretch each bundle between separate godet means, associated to each bundle by the same stretching ratio to all bundles;

heating each of said bundles to a uniform temperature above 40 centigrades during the stretching;

deviating each bundle at a first point below said first and said second godet means to only one second point common to all bundles, lying in said vertical plane at one side of all of said first points to thereby plying said bundles to a cable of at least three bundles, said cable having a denier of more than 10,000 dtex;

advancing said cable with more than 2,500 m/min by only one common draw-off means;

after said stretching and said deviating, shrinking said filaments of all of said bundles in a common shrinking zone consisting of all of said second godet means and said one common draw-off means, the peripheral speed of which being less than the peripheral speed of said second godet means for shrinkage of the filaments;

and releasing the tension in said cable and decreasing the axial running speed of said cable to less than 10% of its previous velocity for depositing the cable in a horizontal collection plane in a can which is reciprocating in said horizontal plane.

15. A process as claimed in claim 14, and heating each of said bundles by means of said second godet means.

16. A process as claimed in claim 14, the peripheral speed of said one common draw-off means being 1 to 5% less than the peripheral speed of said second godet means.

* * * * *

UNITED STATES PATENT AND TRADEMARK OFFICE

CERTIFICATE OF CORRECTION

PATENT NO. : 4,185,064

DATED : January 22, 1980

INVENTOR(S) : Schippers, Heinz

It is certified that error appears in the above-identified patent and that said Letters Patent are hereby corrected as shown below:

In column 6, line 22, change "shrinking" to --shrinkage--;

In column 7, line 39, change "the process" to --said process--;

In column 8, lines 31-32, change "shrinking" to --shrinkage--;

In column 8, line 36, after "of the filaments;" insert

--, each bundle being heated in said shrinkage zone to a temperature between 140 and 230°C.;--

In column 8, after the last line of Claim 16, insert original Claim 13 as Claim 17:

-- 17. A process as claimed in Claim 7, the peripheral speed of said one common draw-off means being less than the peripheral speed of said third godet means for shrinking said bundles. --

Signed and Sealed this

Third Day of June 1980

[SEAL]

Attest:

SIDNEY A. DIAMOND

Attesting Officer

Commissioner of Patents and Trademarks